US005507415A

United States Patent [19]

Sizemore

[11] Patent Number: 5,507,415

[45] Date of Patent: Apr. 16, 1996

[54] CUP-TYPE VENDING SYSTEM AND METHOD FOR DISPENSING BEVERAGES

[76] Inventor: Sean S. Sizemore, 1509 Salem Lake Rd., Winston-Salem, N.C. 27107

[21] Appl. No.: 236,184

[22] Filed: May 2, 1994

Related U.S. Application Data

[62] Division of Ser. No. 2,268, Jan. 8, 1993, Pat. No. 5,341,957.

[51] Int. Cl.[6] ..... B67D 5/56

[52] U.S. Cl. ..... 222/129.1; 222/2

[58] Field of Search ..... 222/129.1, 129.4, 222/2, 325, 66, 255

[56] References Cited

U.S. PATENT DOCUMENTS

| | | | |
|---|---|---|---|
| 4,467,941 | 8/1984 | Du | 222/1 |
| 4,544,328 | 10/1985 | Credle, Jr. | 417/33 |
| 4,615,466 | 10/1986 | Credle, Jr. | 222/129.1 |
| 4,629,589 | 12/1986 | Gupta et al. | 261/34.1 |
| 4,753,370 | 6/1988 | Rudick | 222/105 |
| 4,781,310 | 11/1988 | Credle, Jr. et al. | 222/129.1 |
| 4,801,048 | 1/1989 | Credle, Jr. et al. | 222/129.1 |
| 4,898,303 | 2/1990 | Large et al. | 222/65 |
| 4,913,316 | 4/1990 | Richter | 221/1 |
| 4,928,853 | 5/1990 | Isham et al. | 222/108 |
| 5,000,351 | 3/1991 | Rudick | 222/105 |
| 5,042,689 | 8/1991 | Mrugala et al. | 222/66 |
| 5,082,143 | 1/1992 | Schramm, Jr. | 222/66 |
| 5,086,951 | 2/1992 | Nakayama et al. | 222/129.1 |
| 5,121,857 | 6/1992 | Hutchinson | 222/318 |
| 5,145,092 | 9/1992 | Shannon | 222/61 |

*Primary Examiner*—Gregory L. Huson
*Attorney, Agent, or Firm*—Rhodes, Coats & Bennett

[57] ABSTRACT

A beverage vending system for successively outputting beverages into cups. The beverage vending system includes a vending machine having a currency output device and automatically outputs a beverage into a cup in response to an operator's payment and selection of a beverage. The vending machine including a plurality of disposable containers of beverage syrup, such as bag-in-box packages, stored in an auxiliary cabinet. The disposable containers interconnected to the vending machine by a dispensing system. The dispensing system functioning to draw syrup from the disposable containers and selectively dispense a predefined or selected amount of syrup through an output nozzle and into an awaiting cup. The dispensing system includes a first pumping stage having a first pump for drawing the syrup from the disposable packages through a supply conduit and then pumping the syrup downstream through a feed conduit towards the output nozzle. Syrup from the first pumping stage passes through a vent valve connected in the feed conduit for removing air as the syrup moves through the vent valve. The dispensing system further includes a second pumping stage disposed downstream of the vent valve. The second pumping stage includes a bellows pump for drawing a selected amount of syrup from said feed conduit and then discharges the selected amount through the output nozzle and into a cup. A vacuum pressure regulator is positioned upstream of the bellows pump to control the pressure of the syrup pumped towards the bellows pump.

3 Claims, 1 Drawing Sheet

CUP-TYPE VENDING SYSTEM AND METHOD FOR DISPENSING BEVERAGES

This application is a division, of application Ser. No. 002,268, filed Jan. 8, 1993, now U.S. Pat. No. 5,341,957.

FIELD OF THE INVENTION

The present invention is related generally to beverage dispensing vending machines, and more particularly to cup-type vending machines.

BACKGROUND OF THE INVENTION

The two primary types of vending machines used to dispense beverages are bottle/can vending machines which dispense individual, pre-packaged beverages and cup-type vending machines which dispense a liquid beverage from a nozzle and into an awaiting cup. The bottling industry both supplies and maintains a large control over the current bottle/can vending machines.

The vending industry has recognized the need to increase the use of cup-type vending machines in order to compete with bottle/can vending machines. In order for cup-type vending machines to better compete with bottle/can vending machines, cup-type vending machines of the prior art need to be improved.

Cup-type vending machines must be designed to successively dispense beverages into cups. The successive dispensing of beverages should not be periodically interrupted by failures in the vending machine to properly dispense a beverage. In addition, cup-type vending machines should be designed to offer a wide variety of beverages and should limit the intervals at which machines must be restocked.

Problems and difficulties have occurred with cup-type vending machines due to a recent development in how beverage syrup located in the vending machine is packaged. Early cup-type vending machines used non-pressurized, holding tanks to supply the beverage syrup. The holding tanks used with the early cup-type vending machines were rigid and contained air. Because of the rigid shape of the holding tank, and the fact that the air was contained in the top section of the tank, and a withdrawal tube drew syrup from a point beneath the level of the fluid, such vending machines did not have a problem with air entering the dispensing system. A recent change in the preferred packaging of syrup has created problems for cup-type vending machines that have not been overcome by the vending industry.

The preferred packaging of beverage syrups which supply vending machines is now a disposable, flexible package referred to as a bag-in-box package (BIB package). BIB packages include a flexible bag for containing syrup and a box for holding the bag, and are preferred because of sanitation and economy factors. The BIB packages are designed to be connected to a dispensing system that controllably dispenses a fixed amount of syrup into a cup. Once all the syrup in a BIB package has been dispensed, the used BIB package is disposed and a full BIB package is brought on line. In order to limit the intervals at which a vending machine must be restocked, BIB packages containing the same type of syrup are sequentially connected by a changeover valve that automatically switches to a second full BIB package upon depletion of a first BIB package.

One primary problem with cup-type vending machines of the prior art is their inability to account for air that enters the dispensing system when BIB packages are used to supply the vending machine. The BIB packages used to dispense syrup contain at least some air in the bags and when a full BIB package is manually placed on-line or when a full BIB package is automatically switched on line by a change-over valve, air will enter the dispensing system.

Prior art dispensing systems used in cup-type vending machines include a bellows pump which uses a vacuum to successively draw a pre-set amount of syrup from the syrup supply for each vend. A vend refers to each time a customer makes a payment into the vending machine and selects a beverage. When these prior art dispensing systems are used with BIB packages, air from the BIB packages enters the dispensing system and flows through the bellows pump. The bellows pump treats air in the system as if it were syrup and destroys the dispensing system's ability to successfully draw and dispense a pre-set amount of syrup into a cup for each vend. Each time a new BIB package is brought on-line, air enters the dispensing system and causes approximately two to five vends to malfunction and not properly dispense beverage syrup into the awaiting cup.

In a vending environment, the failure of the dispensing system to properly dispense the selected beverage for several successive vends each time a new BIB package is brought on-line is a serious problem. Customers may rightfully refuse to patronize a cup-type vending machine that fails to dispense the selected beverage after the vending machine has accepted payment from the customer.

No one in the vending industry has solved the problem of air entering the dispensing system when BIB packages are used. One different type of beverage dispensing system, a counter-top beverage dispenser typically used for over-the-counter sales, has been adapted with a vent valve to help eliminate air entering the dispensing system when BIB packages are used. Unlike vending machines, counter-top beverage dispensers do not require a direct payment into a coin-operated mechanism controlling the beverage dispenser. Instead, for the counter-top beverage dispensers, a customer typically pays an operator who dispenses the beverage by pressing the selection button, and allows an individual to release a beverage from a nozzle upon pressing a selection button or cup lever associated with an offered beverage.

The selection button activates a solenoid-operated valve which releases a pressurized beverage fluid. In a limited number of counter-top beverage dispensers, a vent valve is positioned before the solenoid-operated valve which controls the release of the beverage into a cup. The counter-top beverage dispensers are pressurized systems that continuously supply and maintain a pressurized beverage fluid to the solenoid-operated valve. Vent valves are infrequently used in counter-top beverage dispensers because the introduction of air into the dispensing system of a counter-top beverage dispenser is not a significant problem. Because the dispensing systems of counter-top beverage dispensers are pressurized, air is compressed at the solenoid valve. Compressed air does not substantially interfere with the dispensing of beverages from the solenoid valve and seldom causes malfunctioning vendor serves where a customer fails to receive a beverage after payment and selection has been made. When a malfunctioning vend does occur in a counter-top beverage machine, no significant problem occurs because an operator simply re-presses the beverage release button to allow the air to escape.

In contrast, cup-type vending machines use a different type of dispensing system and are designed for a different purpose. Cup-type vending machines, for example, use a vacuum-type dispensing system, and in addition, malfunctioning vends cannot be rectified by an operator simply re-pressing a button. Air introduced into a vacuum-type dispensing system has a more adverse effect on the dispensing system and creates more vending malfunctions as compared to a pressurized system using a solenoid valve. In addition, a customer is left without a beverage after making a payment when there is a malfunctioning of a vending machine. Thus, introduction of air into the dispensing system of a cup-type vending machine creates a substantial problem. No one in the vending industry has successfully solved this problem.

Another hindrance to expanded use of cup-type vending machines is the relatively large space requirements needed for a cup-type vending machine. Cup-type vending machines typically offer several different types of beverages for selection. For each beverage offered for selection, multiple BIB packages and a separate pumping system is needed for each beverage offered. Further, other components such as a cup carousel, a carbonator, a refrigeration system, a $CO_2$ cylinder, and an icemaker must also be made available.

Some cup-type vending machines of the prior art do not have the space for a plurality of BIB packages. Many cup-type vending machines currently available are designed to supply beverage syrup from holding tanks. These currently available vending machines cannot typically be easily converted to hold a plurality of BIB packages. In an attempt to reduce the space requirements, the number of beverages offered for selection or the number of BIB packages successively connected together for each type of beverage can be reduced. However, limiting the number of beverages offered for selection reduces total sales, and limiting the number of packages successively connected together requires the machines to be restocked more frequently. Such measures to account for the space requirements of a vending machine limits the ability of cup-type vending machines to compete with bottle/can vending machines.

The vending industry has not been able to solve the above-discussed problems of cup-type vending machines, and an improved cup-type vending machine is needed.

SUMMARY OF THE INVENTION

The present invention is an improved beverage vending system for automatically dispensing an offered beverage into a cup in response to a customer's payment and selection of an offered beverage. Each offered beverage is supplied by a plurality of disposable bag-in-box packages (BIB packages) that contain both syrup and air and that are connected together by a changeover valve. The improved beverage vending system includes an auxiliary cabinet for storing the BIB packages. The vending machine is interconnected to the auxiliary cabinet by a dispensing system. The auxiliary cabinet provides ample storage space for the BIB packages and other system components. In addition, the dispensing system is designed to eliminate malfunctioning vends or serves caused in prior art cup-type vending machines when air from the BIB packages enters the dispensing system of the beverage vending system.

The dispensing system is used to draw syrup from the BIB packages and selectively dispense a predefined amount of syrup through an output nozzle into an awaiting cup. The dispensing system includes a first pumping stage, a second pumping stage, and a vent valve connected between the first pumping stage and the second pumping stage. The first pumping stage includes a supply or BIB pump located in the auxiliary cabinet for drawing syrup from the BIB packages and pumping syrup downstream under pressure through a feed conduit to the second pumping stage located in the vending machine. It is the function of the supply pump to maintain a predetermined pressure level in the feed conduit. As the syrup is pumped to the second pumping stage, the syrup passes through the vent valve under pressure. The increased pressure causes any air which has entered the dispensing system to be vented by the vent valve rather than being passed to the second pumping stage. The second pumping stage includes a bellows pump for drawing a selected amount of syrup that has been passed through the vent valve and dispensing a selected amount of syrup into a cup. A pressure regulator is also positionable between the vent valve and the bellows pump for regulating the pressure of the syrup directed to the bellows pump.

Cup-type vending machines of the prior art that include a dispensing system with a bellows pump are convertable into a beverage vending system of the present invention. A conversion kit or syrup delivery kit including a pump, a vent valve, and a vacuum pressure regulator can be used to convert a cup-type vending machine of the prior art. To convert a prior art cup-type vending machine, the pump in the conversion kit is connected in the dispensing system between a supply conduit which connects to the BIB packages and to a feed conduit which leads towards the bellows pump. Once the pump is connected in the dispensing system, the pump transfers syrup downstream towards the bellows pump. The vent valve is connected in the feed conduit and vents air from the dispensing system. The vacuum pressure regulator is connected in the feed conduit after the vent valve and before the bellows pump to regulate the pressure of the syrup flowing towards the bellows pump. By connecting the pump, the vent valve, and the vacuum pressure regulator of the conversion kit in this manner, the cup-type vending machine of the prior art is converted into a beverage vending system of the present invention.

Accordingly, it is an object of the present invention to provide a beverage vending system that eliminates air from the dispensing system to prevent malfunctioning vends.

Another object of the present invention is to provide a beverage vending system allowing for the storage of a plurality of disposable syrup containers and other system components.

Another object of the present invention is to provide a conversion kit for converting cup-type vending machines of the prior art to eliminate the problem of air entering the dispensing system.

DETAILED DESCRIPTION OF THE INVENTION

Figure 1:
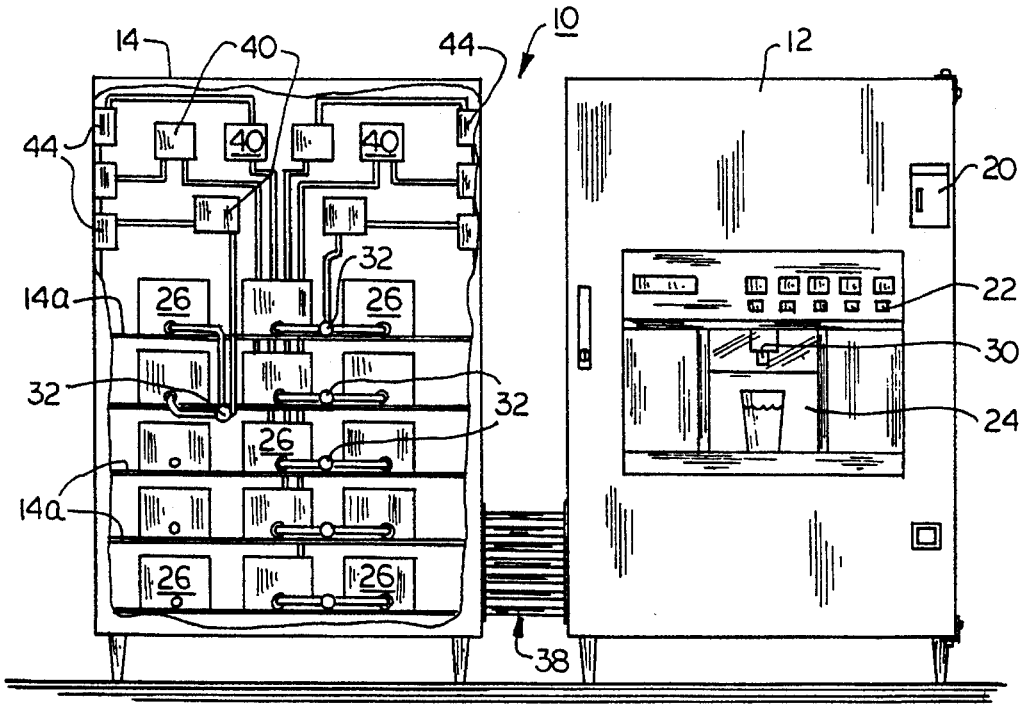
FIG. 1 is an overall view of the cup-type vending system showing the vending machine and the auxiliary cabinet.

Referring to the drawings, the beverage vending system of the present invention is indicated generally by the numeral 10. Beverage vending system 10 includes a vending machine 12, an auxiliary cabinet 14 and a beverage dispensing system 16. As shown in FIG. 1, vending machine 12 includes certain features common to cup-type vending machines of the prior art. On the front panel of the vending machine 12 is a currency input device 20 for a customer to deposit payment for a beverage. Currency input device 20 is a coin-operated device which accepts either coins or dollar bills. Beverage selection buttons 22 allow a customer to select the beverage of his choice. Once payment and selection has been made by the customer, a cup dispensing chamber 24 dispenses and supports a cup to receive the selected beverage.

An auxiliary cabinet 14 is included in the cup-type vending system 10 to store disposable packages or containers of syrup used to supply the offered beverages. The preferred type of disposable packages used by vending system 10 are bag-in-box packages 26 (BIB packages). BIB packages 26 are known in the prior art and are aluminized plastic bladder bags that are flexible and filled with syrup and placed in a cardboard container. A full bag of BIB packages 26 will include both beverage syrup and air. Auxiliary cabinet 14 provides additional space to store a plurality of BIB packages 26 required for a vending machine 12 that offers a variety of beverage selections. Two BIB packages 26 containing the same type of beverage syrup can be sequentially connected together by a changeover valve 32. Changeover valves 32 are known in the prior art and sequentially place BIB packages having a full supply of syrup as a connected BIB package is depleted of syrup. The BIB packages 26 can be stored in cabinet 14 on racks **14*a* used to support BIB packages 26. The BIB packages 26 stored within auxiliary cabinet 14 are interconnected to vending machine 12 by supply conduits 28 (shown in FIG. 1) which form a part of beverage dispensing system 16**.

Figure 2:
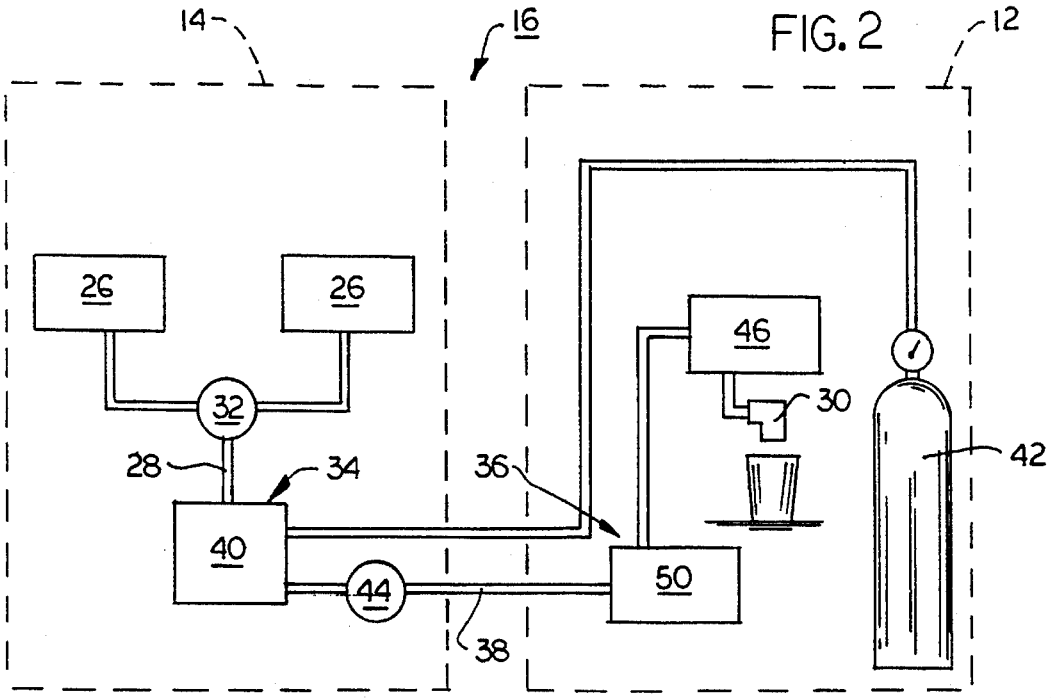
FIG. 2 is a schematic view of the beverage dispensing system of the present invention.

Beverage dispensing system 16 pumps syrup from the BIB packages 26 to an output nozzle 30 which directs the beverage syrup to an awaiting cup. FIG. 2 schematically shows a beverage dispensing system 16 designed to pump beverage syrup from a single type of beverage offered by vending machine 12. The beverage dispensing system 16 shown in FIG. 2 is duplicated to allow for dispensing of other types of beverages offered by vending machine 12. Beverage dispensing system 16 includes a first pumping stage 34 and a second pumping stage 36. First pumping stage 34 is used to withdraw syrup from the BIB package and to pump the syrup downstream from the auxiliary cabinet 14 to the second pumping stage located in vending machine 12. In response to payment and selection of beverage, the second pumping stage 36 pumps a predefined selected amount of syrup through output nozzle 30 and into an awaiting cup.

First pumping stage 34 includes a BIB pump 40 used to draw syrup from BIB packages 26. The intake stroke of the BIB pump 40 creates a vacuum which draws syrup from a BIB package 26 through a supply conduit 28 constructed of PVC tubing and to pump 40. The discharge stroke of BIB pump 40 pumps the drawn syrup downstream towards the second pumping stage 36 through a feed conduit 38 constructed of LDPE tubing. BIB pump 40 is powered by a $CO_2$ cylinder 42 located in vending machine 12.

A vent valve 44 is positioned in supply conduit 28 to remove any air intermixed with the syrup pumped from the BIB pump 40. Vent valves 44 are known in the prior art and may be referred to as a "BIB vent". The vent valve 44 used in the preferred embodiment of the invention is offered by the Lancer Corporation and is identified as P.N. 82-0290. Vent valve 44 functions to remove any air that may have entered the dispensing system 16 during the first pumping stage 34. Air tends to enter dispensing system 16 because the bag of a BIB package 26 is flexible. The flexible nature of the BIB package's bag allows air within the bag to be drawn into supply conduit 28 when the intake stroke of pump 40 draws syrup from a BIB package 26. Removal of air from dispensing system 16 is important due to the inability of the second pumping stage 36 to properly function when air is intermixed with the syrup.

Second pumping stage 36 includes a bellows pump 46 positioned upstream of output nozzle 30. Bellows pumps 46 are currently used in prior art cup-type vending machines. Bellows pump 46 has an intake stroke that creates a vacuum to withdraw a pre-selected amount of syrup from the first pumping stage 34. The output stroke of the bellows pump forces the selected amount of syrup through output nozzle 30 and into an awaiting cup. Positioned between bellows pump 46 and vent valve 44 is a fluid flow restricting means preferably in the form of a vacuum pressure regulator 50. Vacuum pressure regulator 50 prevents syrup in the pressurized feed conduit 38 from inadvertently passing through the bellows pump 46 and also controls the flow of fluid delivered to the bellows pump when it is activated. While vacuum pressure regulator 50 is the preferred form of fluid flow restricting means, other types could be used, such as, for example, an electrically-operated solenoid valve with a fluid flow device.

In operation, beverage vending system 10 operates as follows. BIB packages 26 are stored in auxiliary cabinet 14. For each beverage offered by vending machine 12, a pair of BIB packages 26 are connected in parallel to a change-over valve 32. A single BIB package can be used, but a pair of BIB packages connected by a changeover valve is preferred to limit the intervals at which vending system 10 must be restocked. Once the BIB packages 26 are connected with beverage dispensing system 16, the first pumping stage 34 begins pumping syrup contained within one of the BIB packages 26 downstream towards the second pumping stage 36. The intake stroke of the BIB pump 40 produces a vacuum which draws syrup from the BIB package 26 on-line and through supply conduit 28, while the output stroke of the BIB pump 40 forces syrup downstream through feed conduit 38 and towards vent valve 44.

The syrup under pressure from BIB pump 40 is directed through vent valve 44 connected along supply conduit 28. Vent valve 44 releases air that may be intermingled with the syrup. As new BIB packages 26 are brought on-line, air tends to enter the beverage dispensing system 16. First pumping stage 34 is used to transfer syrup located in auxiliary cabinet 14 to the second pumping stage 36 located in vending machine 12. Vent valve 44 functions to condition the syrup drawn from BIB packages 26 such that only pressurized syrup without intermingled air is transferred to second pumping stage 36.

Vacuum pressure regulator 50 prevents the pressurized syrup from the first pumping stage from being passed directly to bellows pump 46. Syrup from first pumping stage 34 must be sufficiently pressurized to continuously and uniformly transfer the syrup from the remote cabinet 14 to the vending machine 12. However, the pressurized syrup from the first pumping stage may cause the bellows pump to malfunction if the syrup is allowed to pass directly to the bellows pump 46. Typical bellows pumps 46 are not ordinarily designed to withstand much pressure at their intake port and will inadvertently discharge syrup if the syrup from the first pumping stage 34 is allowed to pass directly to the bellows pump 46. To prevent inadvertent discharges from the bellows pump 46, vacuum pressure regulator 50 is placed between bellows pump 46 and vent valve 44. Vacuum pressure regulator 50 allows syrup to pass to bellows pump 46 only in response to a vacuum created by the intake stroke of bellows pump 46.

Bellows pump 46 is activated to dispense a pre-selected quantity of syrup in response to a customer's insertion of payment into currency input device 20 and selection of a beverage. Once a customer has made a sufficient payment to vending machine 12 and also pressed a beverage selection button 22, bellows pump 46 cycles to dispense a pre-selected amount of syrup into a cup positioned into cup dispensing chamber 24. A cycle of the bellows pump 46 includes an intake stroke which produces a vacuum which causes vacuum pressure regulator 50 to release syrup from the first pumping stage 34. The released syrup is a pre-selected amount of syrup required to supply a single cup. The output stroke of the bellows pump 46 then forces the pre-selected amount of syrup through output nozzle 30 and into a cup. A complete vend occurs when the preselected amount of syrup is forced from the bellows pump 46 during the output stroke and when the preselected amount of syrup is drawn into the bellows pump 46 during the intake stroke.

The beverage vending system 10 of the present invention has two primary advantages over prior art cup-type vending systems. First vending system 10 of the present invention allows a vending machine operator to store a much larger number of BIB packages 26 and other components such that vending system 10 requires less frequent stocking of BIB packages 26. In addition, when restocking the cup-type vending system 10, access to the vending machine 12 is not required. Second, the air problem associated with cup-type vending machines of the prior art is solved by including a dispensing system 16 having both a first and second pumping stages 35,36 with a vent valve positioned therebetween.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

I claim:

1. A syrup delivery kit for a cup-type vending machine in which the syrup is initially contained in a disposable container and having a second pump which delivers a predetermined amount of syrup through a conduit to a nozzle, said kit comprising:

a) a supply pump connectable in the dispensing system to the disposable container for transferring syrup downstream through a feed conduit towards the second pump;

b) a vent valve connectable in the feed conduit between the supply pump and the second pump for removing air from the system; and c) a fluid flow restricting means for preventing syrup in the feed conduit from inadvertently passing through the second pump and for controlling the flow of syrup delivered to the second pump when it is activated, the fluid flow restricting means connectable between the vent valve and the second pump.

2. The syrup delivery kit of claim 1 wherein the fluid flow restricting means is a vacuum pressure regulator.

3. The syrup delivery kit of claim 1 wherein the fluid flow restricting means includes an electrically operated solenoid valve and a fluid flow control device.

* * * * *